US007946233B2

(12) United States Patent
Hall et al.

(10) Patent No.: US 7,946,233 B2
(45) Date of Patent: May 24, 2011

(54) SYSTEM AND METHOD FOR FORMING ARTIFICIAL/SYNTHETIC SPORTS TURF FABRICS

(75) Inventors: Wilton Hall, Ringgold, GA (US); Cody Godfrey, Chatsworth, GA (US); Marshall Allen Neely, Soddy Daisy, TN (US)

(73) Assignee: Card-Monroe Corp., Chattanooga (Hixson), TN (US)

( * ) Notice: Subject to any disclaimer, the term of this patent is extended or adjusted under 35 U.S.C. 154(b) by 406 days.

(21) Appl. No.: 12/197,673

(22) Filed: Aug. 25, 2008

(65) Prior Publication Data

US 2009/0050037 A1 Feb. 26, 2009

Related U.S. Application Data

(60) Provisional application No. 60/981,546, filed on Oct. 22, 2007, provisional application No. 60/976,089, filed on Sep. 28, 2007, provisional application No. 60/957,842, filed on Aug. 24, 2007.

(51) Int. Cl.
*D05C 15/32* (2006.01)
*D05C 15/04* (2006.01)

(52) U.S. Cl. ..... 112/80.54; 112/80.4; 112/80.55

(58) Field of Classification Search ..... 112/70.4–80.71
See application file for complete search history.

(56) References Cited

U.S. PATENT DOCUMENTS

| | | | | |
|---|---|---|---|---|
| 2,990,792 | A | | 7/1961 | Nowicki et al. |
| 3,084,645 | A | | 4/1963 | Card |
| 3,203,379 | A | | 8/1965 | Dedmon et al. |
| 3,577,943 | A | | 5/1971 | Watkins |
| 3,618,542 | A | | 11/1971 | Zocher |
| 3,662,697 | A | | 5/1972 | Passons et al. |
| 3,709,173 | A | | 1/1973 | Greene |
| 3,780,678 | A | * | 12/1973 | Short ..... 112/80.53 |
| 3,835,797 | A | | 9/1974 | Franks et al. |
| 3,847,098 | A | | 11/1974 | Hammel, Jr. |
| 3,919,953 | A | | 11/1975 | Card et al. |
| 4,048,930 | A | | 9/1977 | Card |
| 4,103,629 | A | | 8/1978 | Card |
| 4,119,049 | A | | 10/1978 | Puckett |
| 4,134,347 | A | | 1/1979 | Jolley et al. |

(Continued)

FOREIGN PATENT DOCUMENTS

GB 2002040 7/1979

(Continued)

OTHER PUBLICATIONS

International Search Report and Written Opinion for related application No. PCT/US2008/074222 filed Aug. 25, 2008.

*Primary Examiner* — Ismael Izaguirre

(74) *Attorney, Agent, or Firm* — Womble Carlyle Sandridge & Rice PLLC

(57) ABSTRACT

A system and method for forming synthetic/artificial grass or turf products in which a series of tufts of artificial/synthetic grass filaments or yarns are formed in a backing material. The system generally will include spaced rows of needles mounted along a tufting zone and which are reciprocated through the backing to different penetration depths. A series of loopers and a series of hooks will be aligned with and will engage the needles in order to form cut and loop pile tufts of yarns having varying lengths in the backing material.

22 Claims, 9 Drawing Sheets

U.S. PATENT DOCUMENTS 4,155,319 A 5/1979 Short
4,185,569 A 1/1980 Inman
4,217,837 A 8/1980 Beasley et al.
4,226,196 A 10/1980 Booth
4,353,317 A 10/1982 Crumbliss
4,366,761 A 1/1983 Card
4,398,479 A 8/1983 Czelusniak, Jr.
4,419,944 A 12/1983 Passons et al.
4,440,102 A 4/1984 Card et al.
4,466,366 A 8/1984 Hirotsu
4,557,208 A 12/1985 Ingram et al.
4,557,209 A 12/1985 Watkins
4,619,212 A 10/1986 Card et al.
4,630,558 A 12/1986 Card et al.
4,754,718 A 7/1988 Watkins
4,800,828 A 1/1989 Watkins
4,815,403 A 3/1989 Card et al.
4,836,118 A 6/1989 Card et al.
4,856,441 A 8/1989 Kurata
4,860,674 A 8/1989 Slattery
4,864,946 A 9/1989 Watkins
4,903,624 A 2/1990 Card et al.
4,903,625 A 2/1990 Card et al.
4,993,336 A * 2/1991 Mizunuma ..... 112/226
5,058,518 A 10/1991 Card et al.
5,094,178 A 3/1992 Watkins
5,224,434 A 7/1993 Card et al.
5,400,727 A 3/1995 Neely
5,499,588 A 3/1996 Card et al.
5,509,364 A 4/1996 Bardsley
5,544,605 A 8/1996 Frost
5,575,228 A 11/1996 Padgett et al.
5,622,126 A 4/1997 Card et al.
5,706,744 A 1/1998 Card et al.
5,743,201 A 4/1998 Card et al.
5,896,821 A 4/1999 Neely et al.
5,899,152 A 5/1999 Bardsley et al.
5,983,815 A 11/1999 Card
6,009,818 A 1/2000 Card et al.
6,155,187 A 12/2000 Bennett et al.
6,213,036 B1 4/2001 Slattery
6,244,203 B1 6/2001 Morgante et al.
6,263,811 B1 7/2001 Crossley
6,279,497 B1 * 8/2001 Lovelady ..... 112/80.54
6,283,053 B1 9/2001 Morgante et al.
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,758,154 B2 7/2004 Johnston
6,807,917 B1 10/2004 Christman et al.
6,834,601 B2 12/2004 Card et al.
6,834,602 B1 12/2004 Hall
7,007,617 B2 3/2006 Johnston
7,216,598 B1 5/2007 Christman, Jr.
7,490,566 B2 2/2009 Hall
7,739,970 B2 * 6/2010 Hall ..... 112/80.4
2004/0187268 A1 9/2004 Johnston

FOREIGN PATENT DOCUMENTS

GB 2050477 A 1/1981
GB 2115025 A 9/1983
GB 2165560 A 4/1986
GB 2246371 A 1/1992
WO WO2004/057111 A1 8/2004
WO WO2006/075241 A1 7/2006

* cited by examiner

SYSTEM AND METHOD FOR FORMING ARTIFICIAL/SYNTHETIC SPORTS TURF FABRICS

CROSS REFERENCE TO RELATED APPLICATIONS

This application claims the benefit of U.S. Provisional Application No. 60/981,546, entitled SYSTEM AND METHOD FOR FORMING ARTIFICIAL/SYNTHETIC SPORTS TURF FABRICS, filed Oct. 22, 2007, U.S. Provisional Application No. 60/976,089, entitled SYSTEM AND METHOD FOR FORMING ARTIFICIAL/SYNTHETIC SPORTS TURF FABRICS, filed Sep. 28, 2007, and U.S. Provisional Application No. 60/957,842, entitled SYSTEM AND METHOD FOR FORMING ARTIFICIAL/SYNTHETIC SPORTS TURF FABRICS, filed Aug. 24, 2007, each of the listed applications being fully incorporated herein by reference as if set forth in their entireties.

FIELD OF THE INVENTION

The present invention generally relates to tufted fabrics or products and in particular to a method and system for forming artificial/synthetic sports grass or turf fabrics or products.

BACKGROUND OF THE INVENTION

Artificial/Synthetic grass or turf products have been growing in popularity and demand in recent years, especially for use in indoor stadiums and in areas where grass fields are difficult to maintain due to weather conditions. Such synthetic turf products are increasingly typically formed as tufted products with synthetic turf yarns or filaments that simulate blades of grass tufted into a backing material, and with a fill material, such as ground up tires, sand, and/or other particulate matter, generally being applied between the tufts of the synthetic grass filaments to help support the tufts and cushion the turf. During formation, such tufted turf products typically are produced in multiple tufting passes through multiple different tufting machines, such as by first running a backing material through a loop pile tufting machine, in which a series of loop pile tufts are formed in the backing, after which the initially tufted turf product is wound onto a roll and transferred to a cut pile machine for forming cut pile tufts during a second tufting pass of the material. Such an operation is not only very time consuming and results in over-tufting of the fabric, but can be very difficult and cumbersome to perform, especially after the heavier, dense, loop pile tufts are formed in the backing material, which generally must be moved by a crane, lift, or other heavy equipment to transfer it to the cut pile machine. Additionally, since the backing material has already gone through one tufting pass, there can be problems with accurately controlling the feeding and stretch of the backing material as it is run in a second pass through the cut pile tufting machine so as to accurately form the cut pile tufts therein.

The resultant synthetic turf or grass fabric further generally must meet desired standards for cushioning, support, ball bounce, ball roll, and the amount of fill, especially where it is installed in sanctioned athletic fields, such as for professional, college, and high school sports facilities. For example, FIFA, the governing body for international soccer has very specific standards for the amount of cushioning and support to be provided by the synthetic turf material when used for its fields, as well as for ball bounce and the amount of fill that can be used in such synthetic turf fields. There is further a continuing need to try to improve the cushioning, support and playability of synthetic turf fields, as well as a need to reduce as much as possible the amount of fill or particulate matter needed to support the synthetic turf or grass filaments, which particulate matter often gets in players eyes, etc., as it is disturbed during play, in order to improve the players' comfort and help reduce injuries as much as possible.

Accordingly, it can be seen that a need exists for a system and method for forming artificial/synthetic grass or sports turf products that address the foregoing and other related and unrelated problems in the art.

SUMMARY OF THE INVENTION

Briefly described, the present invention generally relates to a system and method for forming tufted fabrics utilizing loop pile and/or cut pile tufts formed from synthetic grass or turf type filaments or yarns inserted into a backing material to form artificial/synthetic grass or turf products. The present invention generally is adapted be utilized in a tufting machine including a first row of needles positioned along an upstream side of a tufting zone of the tufting machine, and a second row of needles spaced transversely across the tufting zone from the first row of needles. Each of the needles generally includes a pick up area and carries a synthetic grass filament or yarn for introduction of the yarns into a backing material as the backing material is moved through the tufting zone. The needles further can be mounted at different elevations or heights, or can be of varying lengths, with the needles of the upstream or first row needles being of a different length or positioned at a different height than the downstream or second row of needles.

A gauging element assembly is located below the tufting zone. The gauging element assembly generally includes a series of loopers mounted on the upstream or first side of the tufting zone and arranged so as to pass between gaps formed between each of the needles of the first row of needles as the first row of needles penetrate the backing material. A series of cut pile hooks can be positioned along the downstream side of the tufting zone opposite the loop pile loopers. The cut pile hooks further can be located at a different elevation from the loopers and generally will be movable between gaps formed between the needles of the second row of needles, and possibly through gaps between the loopers, so as to engage and pick up yarns from corresponding ones of the first row of needles. The loopers likewise generally will be aligned with gaps defined between needles of the first row of needles and the cut pile hooks.

As the needles penetrate the backing material, the loop pile loopers and cut pile hooks are reciprocated toward the needles and each other, with the loop pile loopers generally passing between the upstream or first row of needles so as to engage the downstream or second row of needles, while the cut pile hooks generally pass beneath and/or through gaps defined between the needles of the second or downstream row of needles so as to engage the needles of the first or upstream row of needles. The loop pile loopers and/or cut pile hooks pick and pull the synthetic grass filaments/yarn from their respective needles perform and cut in the loop pile tufts and the backing material, with the cut and loop pile tufts being at different elevations. As a result, the lower tufts tend to fill in and provide additional density and support for the higher tufts, with all of the tufts generally being formed in substantially one pass of the backing material through the tufting machine, without necessarily requiring over-tufting of the tufted material to achieve any desired density. Additionally, it is possible to utilize various configurations of gauging elements, including use of loop pile loopers, cut pile hooks and/or additional gauging elements, such as level cut loop loopers, alone or in combination on one or both sides of the tufting zone.

Various features, advantages and benefits of the present invention will become apparent to those skilled in the art upon a review of the following detailed description, when taken in conjunction with accompanying drawings.

DETAILED DESCRIPTION OF THE INVENTION

Figure 1:
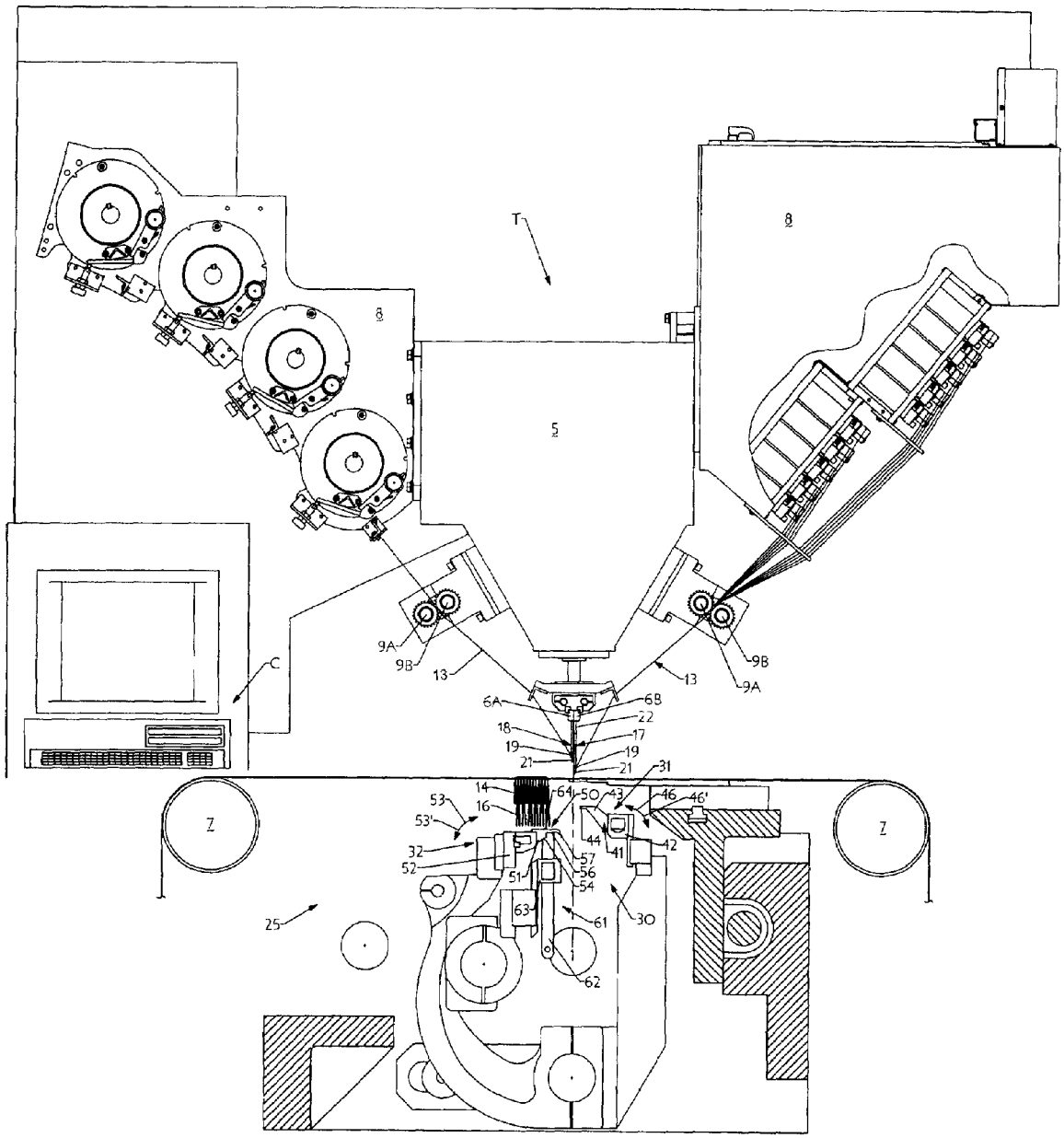
FIG. 1 is a side elevational view illustrating a tufting machine with cut pile hooks and loop pile loopers arranged in opposed, vertically spaced rows according to the present invention.

Referring now in greater detail to the drawings in which like numerals indicate like parts throughout the several views, the present invention generally relates to a method and system for forming tufted fabrics having loop pile and cut pile tufts of synthetic grass filaments or yarns formed therein for forming various artificial/synthetic grass or turf products. As illustrated in FIG. 1, a tufting machine T utilizing the present invention generally will include a tufting zone 10 through which a backing material 11 is fed into a feed direction, generally indicated by arrow 12 for the introduction of yarns (shown by dashed lines 13) into the backing material.

As indicated in FIG. 1, the tufting machine T generally will comprise a tufting machine such as disclosed in U.S. Pat. Nos. 5,979,344, 7,096,806 and/or 7,359,761, the disclosures of which are incorporated by reference as if fully set forth herein. The tufting machine T generally will include a frame 5 on which is supported a machine drive, including a main drive shaft 1 that reciprocally drives one or more reciprocating needle bars, 6A/6B each carrying a row of spaced needles 17, 18 mounted in space series therealong the needle bar(s) and defining the tufting zone 10 through which the backing material 11 is fed by upstream and downstream backing rolls 7. While two needle bars 6A/6B are shown in the present embodiment, it will also be possible to utilize a single needle bar with in-line or staggered rows of needles as illustrated in FIGS. 5A-7 and discussed below. A series of yarns, indicated by 13, are fed from one or more yarn feed mechanisms or devices 8 through pairs of puller rolls 9A and 9B to each of the needles 17 and 18. A system control C, such as a Command Performance Tufting Machine Control as manufactured by Card-Monroe Corp. will control the various operative elements of the tufting machine T including the yarn feed mechanisms so as to control the feeding of the yarns 13 to the needles as the needles penetrate the backing 11 and are engaged by gauging element assembly 25 of the tufting machine in order to form varying height loop and/or cut pile tufts of yarns within the backing material as indicated in FIGS. 1-2.

The yarns 13 used to form the tufted turf fabric according to the present invention generally are synthetic grass filaments or yarns as commonly used for such turf fabrics. The yarns generally are fed to the needles 17/18 from one or more yarn feed mechanisms 8 or sources and are inserted into the backing material 11 to form loop pile tufts 14 and cut pile tufts 16, respectively, in the backing material. The yarn feed mechanism(s) can include scroll, roll, servo-scroll, single-end yarn feed, double-end yarn feed and/or other types of pattern and non-pattern yarn feed devices, such as an Infinity™, Infinity IIE™ or Yarntronics™ yarn feed system or mechanism as manufactured by Card-Monroe Corp. for controlling feeding of the yarns to form various pattern effects in the finished tufted turf fabrics.

Figure 2:
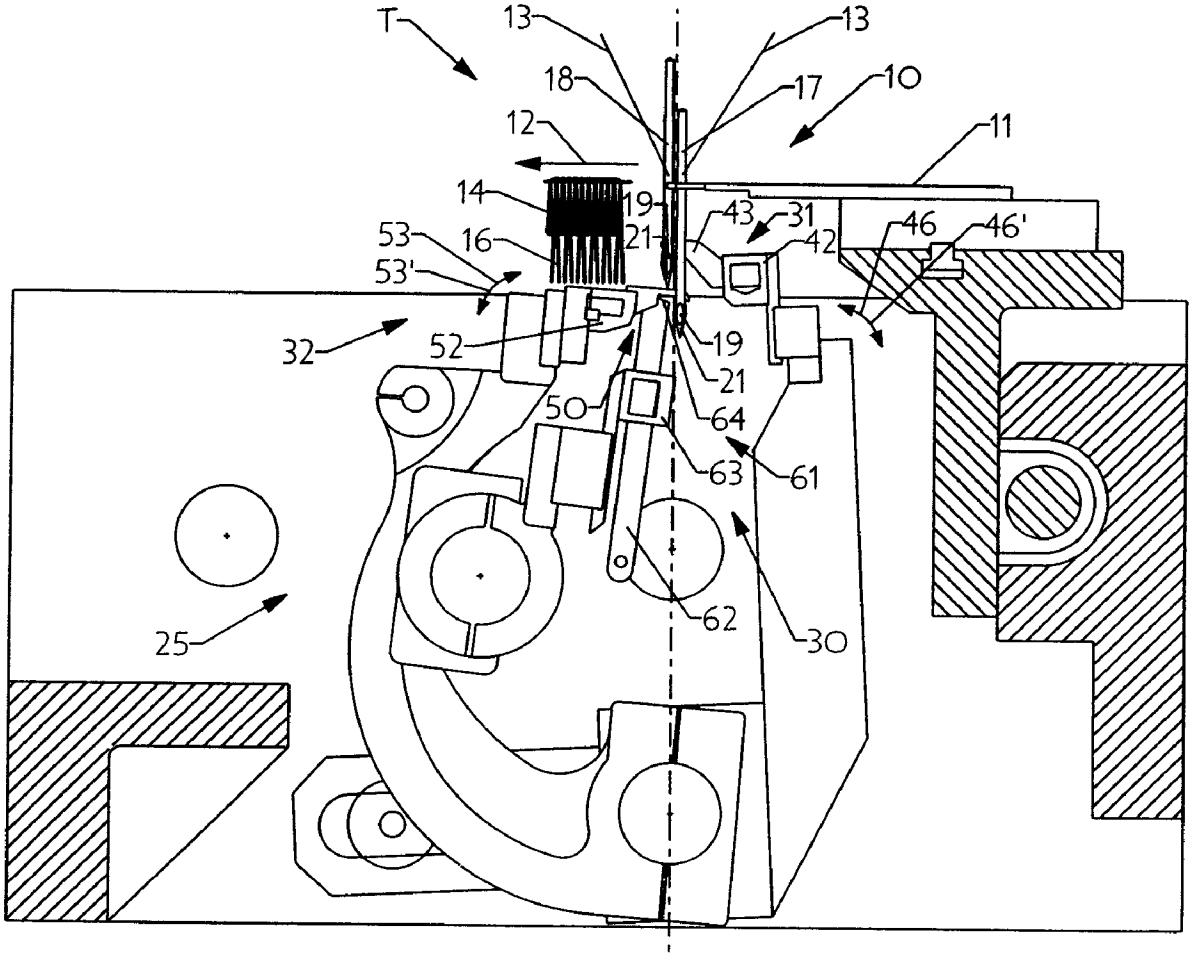
FIG. 2 is a side elevational view illustrating the engagement of the cut pile hooks and loop pile loopers with their associated needles in the tufting machine of FIG. 1.
Figure 3:
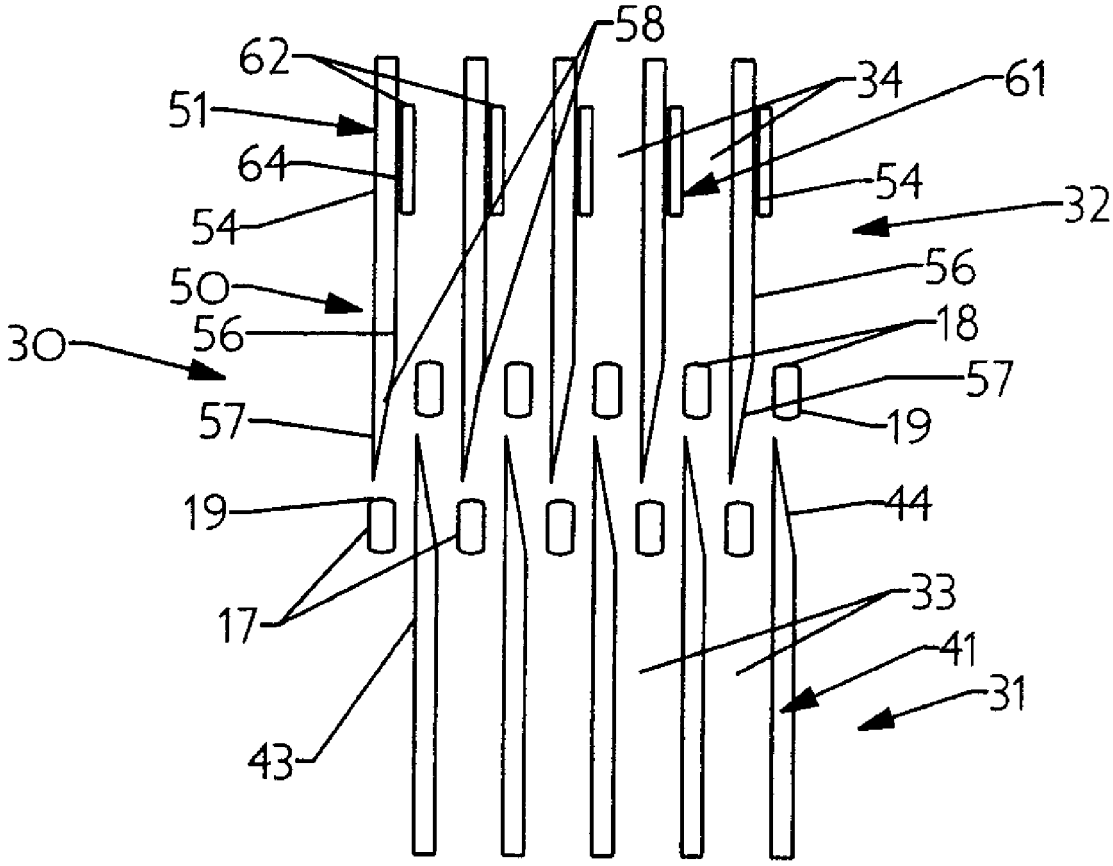
FIG. 3 is a schematic illustration of the movement of the loop pile loopers and cut pile hooks between one another into engagement with the opposed rows of needles according to the present invention.

As indicated in FIGS. 1-3, the tufting machine generally will include two spaced rows of needles 17 and 18, although only one needle 17, 18 of each row is shown in FIGS. 1-2 for clarity. The first or forwardmost/upstream row of needles 17 generally can comprise cut pile needles for inserting yarns for forming cut pile tufts into the backing 11, while the second or rear row of needles 18 can comprise loop pile needles for inserting yarns for forming loop pile tufts into the backing material 11 as show in FIG. 1. Each needle 17 or 18 includes a pickup or takeoff area or portion 19 adjacent their lower end or point 21 and a channel 22 along which a yarn 13 is received. The needles can be mounted in transversely spaced series along a single needle bar or along a pair of reciprocating needle bars 61?6B that are driven by the operation of the main shaft of the tufting machine so as to move the needles through their reciprocating path into and out of the backing material 11 for delivering the yarns 13 thereto. The needle bar or bars further can be dual shiftable needle bars shifted by a shift mechanism (not shown), such as an electric, hydraulic or servo-motor controlled shifter.

Additionally, as shown in FIGS. 1-2, the needles of each row generally are vertically spaced with respect to each other, with the points of the needles of the first or upstream row of needles 17 located at a first elevation so as to project or extend to a first penetration depth or elevation that generally is below the points 21 of the needles 18 of the second row of needles by a pre-set or predetermined vertical spacing. The needles 18 of the second rows of needles are mounted at a second elevation or level that generally is different from the first elevation of the first row of needles 17 so as to penetrate the backing to a second penetration depth that is at a second elevation or level that generally is different from the first elevation of the first row of needles 17 so that their points penetrate the backing at a different penetration depth with respect to needles 17. The needles 17 can be of an increased length relative to the needles 18 to help provide the desired spacing and penetration depth differences through the backing material for each needle stroke. Alternatively, the needles 17 and 18 can be of substantially the same length and can be mounted at substantially different elevations. Typically, the needle stroke or depth of penetration of the needles will be based upon the stroke of the longest needle or deepest pile tuft being formed, with the yarn feed generally being controlled (i.e., pulled back) by the yarn feed mechanism(s) as needed according to the programmed pattern instructions being run by the system control C (FIG. 1) of the tufting machine to help avoid excess yarn bunching or being caught above the backing material.

Mounted beneath the tufting zone 10 is a gauging element assembly 25, which can include a series of loopers, hooks, level cut loop loopers, etc., and/or combinations thereof. In the presently illustrated embodiment, a looper assembly 30 is illustrated in FIG. 1 on one side of the tufting zone. The looper assembly 30 generally includes a series of loop pile loopers 31 mounted in spaced series beneath the cut pile needles 17 at an elevation approximately corresponding to the second penetration depth of the needles 18, arranged along an upstream or first side of a tufting zone 10, and facing in the feed direction 12 of the backing material 11, and a series of transversely spaced cut pile hook assemblies 32 positioned along the downstream side of the tufting zone, and facing in an opposite direction from the loopers. The cut pile hook assemblies additionally are located at an elevation generally corresponding to the first penetration depth of the needles 17, facing in an opposite direction from the loopers 31. The cut pile hook assemblies also will be located at an elevation generally corresponding to the first penetration depth of the needles 17, arranged below the loop pile needles 18 and spaced vertically from the loop pile loopers by a predetermined spacing or distance. It will be understood by those skilled in the art that while only a single loop pile looper and cut pile hook assembly has been illustrated in the drawings for clarity, in practice, a number of loop pile loopers and cut pile hook assemblies will be provided in spaced series extending across the width of the tufting machine, with the number of loopers and cut pile hook assemblies being dependant upon the size of the tufting machine and number of needles thereof.

Figure 4A:
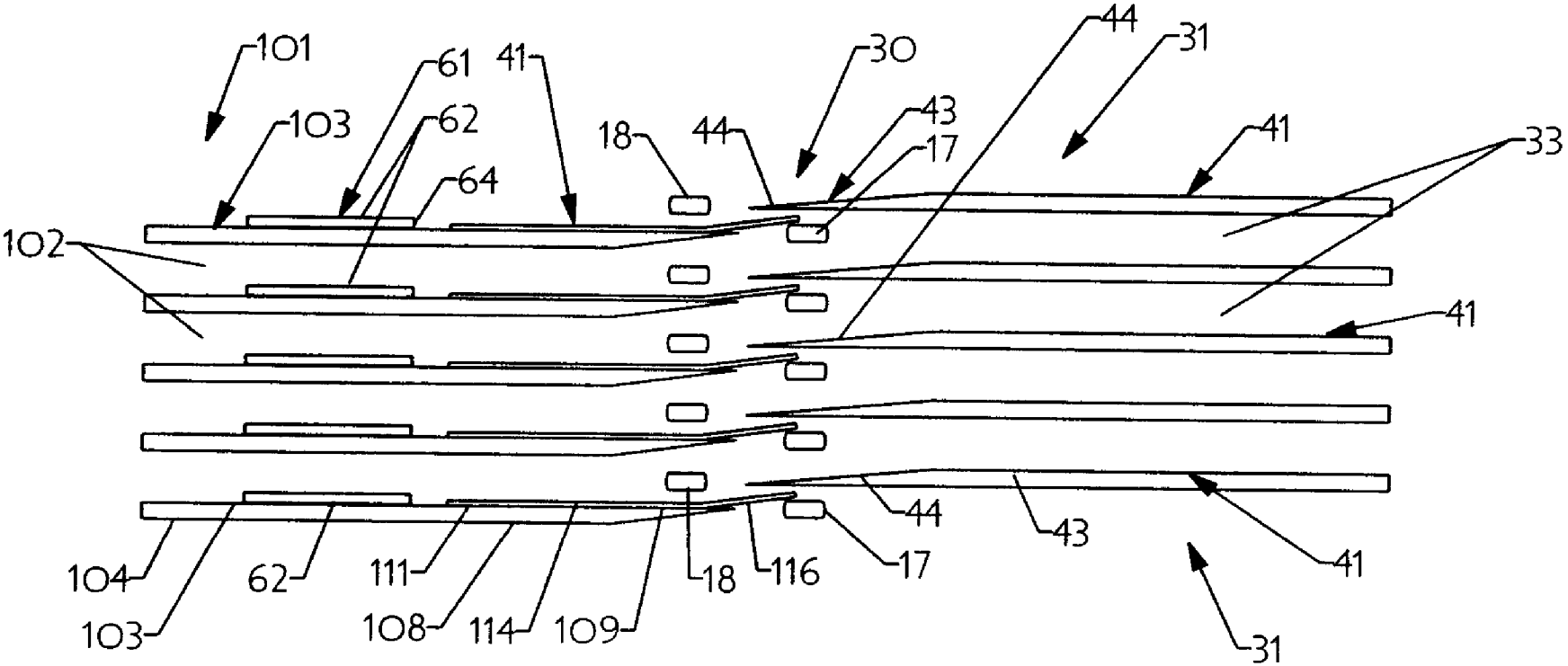
FIG. 4A is a schematic illustration showing the movement of the loop pile loopers and cut/loop loopers or hooks between one another into engagement with the opposed rows of needles according to another possible embodiment of the present invention.
Figure 4B:
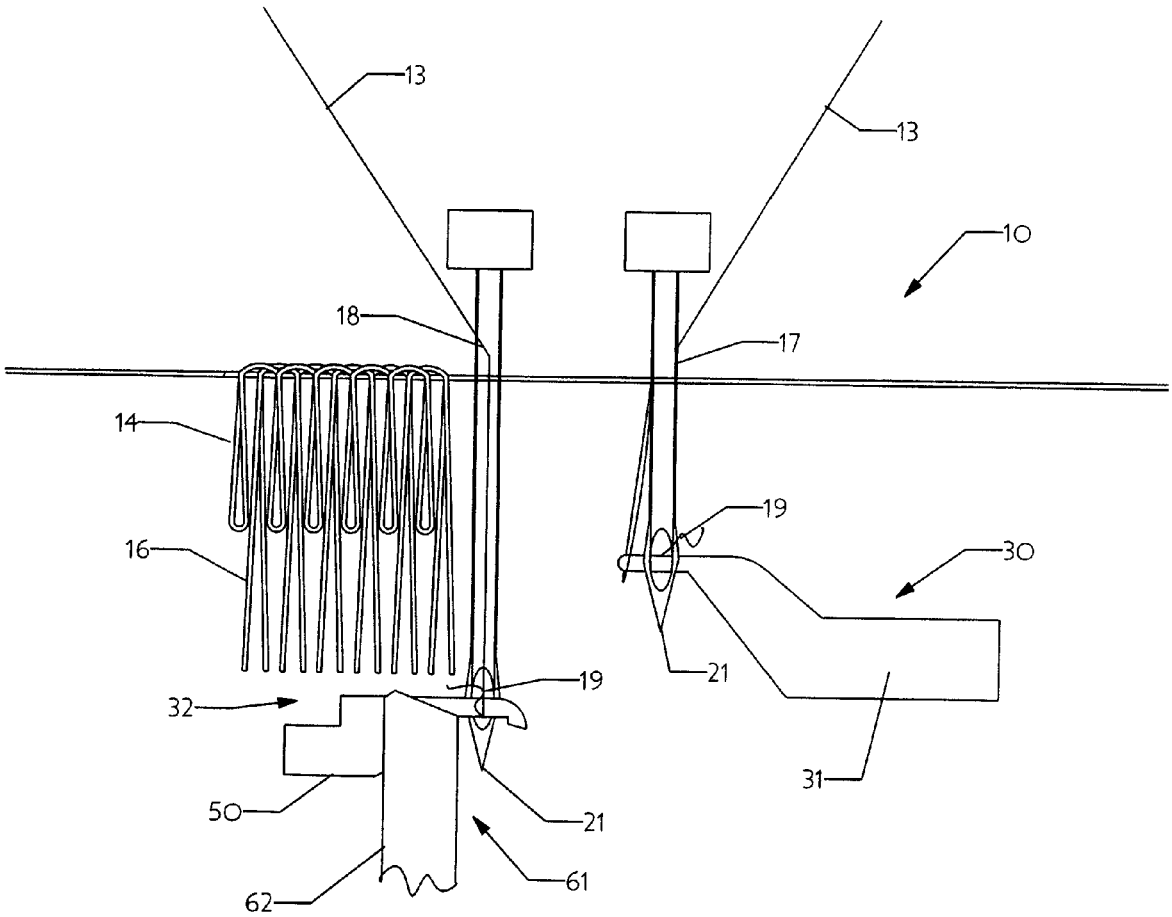
FIG. 4B is a schematic illustration showing an additional alternative embodiment of the present invention.

The system and method of forming artificial/synthetic sports grass or turf fabrics according to the present invention generally can utilize a "Velv-a-Loop" or other, similar tufting machine configuration such as indicated in FIG. 4B, and preferably a Velv-a-Loop cross-over tufting zone configuration, as shown in the drawings such as in FIGS. 1-2, with free lengths of yarns fed from the yarn feed device(s) being controlled to accommodate the engagement and pulling of yarns from the needles by the corresponding loopers/hooks without excess yarns being accumulated above the backing material. Additionally, other systems such as level cut loop looper arrangements with air cylinder driven clips and other cross over arrangements can be used, such as shown in U.S. Pat. No. 6,834,602, the disclosure of which is incorporated herein by reference as if set forth in its entirety.

As shown in FIG. 3, the loopers 31 are spaced transversely apart so as to define gaps 33 therebetween, while the cut pile hook assemblies are transversely spaced and define gaps 34 therebetween. The loop pile loopers are aligned with the gaps 34 between each of the cut pile hook assemblies. Conversely, the cut pile hook assemblies 32 are each aligned with the gaps 33 between the loopers 31. Similarly, the cut pile needles 17 will be positioned so as to travel through the gaps 33 between the loopers, while the loop pile needles 18 are positioned to reciprocate through the gaps 34 between the cut pile hook assemblies 32. In operation, the loopers and cut pile hook assemblies generally will pass between gaps defined between each of the cut pile and loop pile needles, respectively, in an intermeshing type of movement to engage their respective needles on the opposite side of the tufting zone as indicated in FIG. 2.

As illustrated in FIG. 1, each loop pile looper 31 of the looper assembly 30 generally includes a shank portion 41 that is mounted in a holder or block 42; and a forward body or throat portion 43 that terminates in a tapered bill or forward end 44. During operation of the tufting machine, the loop pile loopers are rocked toward their respective needles as indicated by arrow 46 so that the bill portion 44 of each loop pile looper 31 passes into the gap 34 (FIG. 3) between an opposed pair of cut pile hook assemblies 32 and engages the takeoff portion 19 of its associated loop pile needle 18, so as to pick up and pull a loop of yarn away from the loop pile needle 18. As each looper 31 is reciprocated rearwardly in the direction of arrow 46' and the loop pile needles 18 are reciprocated vertically back to their initial, raised position above the backing material, the loopers pick up and pull the yarns 13 away from the needles 18. As a result, a series of loops of yarns will be formed along the bill portion of each looper for forming the loop pile tufts 14 in the backing material.

As illustrated in FIGS. 1 and 3, each of the cut pile hook assemblies 32 comprises a cut pile hook 50 that includes a shank 51 portion mounted within a holder or support 52 (FIG. 1) that carries the hook about a reciprocal motion indicated by arrows 53 and 53', toward and away from engagement with a cut pile needle 17 as illustrated in FIGS. 1 and 2. The hooks 50 (FIGS. 1 and 3A) each further include a body portion 54 that extends upwardly and away from the shank, and a tapered throat portion 56 that terminates in a hooked forward or distal end 57 and can be level as well as unleveled. The hooks each further include a pickup side 58 (FIG. 3) that generally is of an opposite hand to the take off or pickup of the cut pile needles 17. In similar fashion to the loopers 31 (FIGS. 1-2), as the hooks are reciprocated toward and away from their associated cut pile needles 17 in the direction of arrow 53, their barbed front portions 57 pass between adjacent loop pile loopers 31 and engage the takeoff portion 19 of an associated cut pile needle 17 on the opposite side of the tufting zone 10, as the needles 17 are reciprocated to their lowered, engaging position, penetrating in the backing material. As the hooked or barbed front portions 57 of the hooks 50 engage takeoff portions 19 of their associated needles 17 and pick up and pull the yarns away from the cut pile needles 17, the needles are turned or reciprocated upwardly and the hooks 50 are moved in the direction of arrow 53'. As a result, a series of loops of yarn are formed along the throat portions 56 of the hooks 50.

As generally illustrated in FIGS. 1 and 2, the cut pile hook assemblies 32 generally are spaced vertically below the loop pile loopers 31 by a distance that generally corresponds approximately to the vertical spacing of the front needles 17 with respect to the rear needles 18 of the tufting machine. This spacing generally can vary with the pile height of the loop and cut piles being formed, as well as upon the differences between the loop and cut pile tufts to be formed in the resultant turf fabric. For example, for a pile height of 3-6 inches, a spacing of approximately 2.5-4 inches can be used, depending upon the desired pile height of the resultant tufted fabric, although greater or lesser spacings between the cut pile hooks and the loop pile loopers also can be used as needed. The vertical spacing or elevation of the respective loopers and cut pile hooks further can be varied depending upon the gauge or spacing between the tufts of yarns being formed so as to enable tufts of yarn being formed in the tufted turf fabric. Such closer spacing of the cut and loop pile tufts can provide more support to the cut pile tufts of the tuft fabric, which in turn can provide increased or enhanced support with less fill-in of particulate material being required.

Alternatively, the cut pile hooks and loop pile loopers can be positioned with their throats 56/43 at substantially the same depth or elevation. In such an arrangement, the cut pile hooks and/or loop pile loopers generally will be positioned at the lowest level for the deepest pile height tufts being formed. Once the loops of yarns are released from the loop pile loopers, the yarn feed system or mechanism can be controlled to pull back or back-rob the yarns to establish the desired pile height differential, for example, pulling back yarn from the released loop pile loopers by as much as 50% or more to achieve the desired pile height differential. The cut pile hooks and loop pile loopers further can be arranged to pass between each other or to simply engage their respective needles without reaching through the gaps between the opposed cut pile hooks or loop pile loopers, respectively. Still further, the cut pile hooks and loopers can be arranged or spaced so as to engage selected ones of the needles 17/18, for example, having the loopers engage only a portion of the needles 18, with the cut pile hooks engaging the rest, or with the cut pile hooks engaging only selected needles 17 while the loopers engage the rest, depending on the density and other features needed or desired for the artificial/synthetic grass or turf product being formed.

As further illustrated in FIGS. 1-2, each cut pile hook assembly 32 further includes a knife assembly 61 that is mounted adjacent the throat portion 56 of its associated cut pile hook 50. Each knife assembly 61 includes a cutting blade or knife 62 mounted in a holder 63 (FIG. 1) and having a cutting edge 64. Each of the cutting blades 62 are reciprocated about a cutting path along the throat portion 56 of its associated cut pile hook 50, so as to engage and sever the loops of yarn 59 formed along the throat portion of each cut pile hook in order to form the cut pile tufts 16 in the backing material 11.

The knife can be of the same "hand" cutting as the hook, i.e., a right hand cutting blade for a right hand takeoff hook, or a left hand cutting blade for a left hand takeoff hook, and generally will be positioned on the opposite side of the takeoff or pickup region of the looper. Alternatively, as illustrated in FIG. 3, with the cut pile hook assembly 32 of the present invention, the knives 62 are of an opposite hand cutting to the pickup of their associated hooks 50; for example, if the hook is a left hand pickup hook, a right hand cutting blade or knife is used, and conversely, for a hook having a right hand pickup hook, a left hand cutting knife will be used. The knives 62 further are mounted along the pickup side of their hooks as indicated in FIG. 3. As a result, the knives are further aligned with, and thus are on the same side of the hooks as their respective cut pile needles as the needles are engaged by their associated hooks, instead of the needles being positioned on the opposite side of the hooks from the knives. In addition, a J-cut chamfer can be formed on the opposite side of each hook 50 from its pickup side 58.

As the loopers and hooks 31/50 of the looper and hook assemblies 30 and 32 (FIG. 1) are reciprocated in the direction of arrows 47 and 53, respectively, and the loop pile and cut pile needles penetrate the backing material, the bills and throats of the loopers and cut pile hooks will pass adjacent each other without obstruction and will engage their associated loop pile and cut pile needles 18 and 17 to pickup and to form loops of yarn on the throat portion of each of the looper and cut pile hooks. Thereafter, as the knives of each of the cut pile hook assemblies are reciprocated about their cutting path, they will engage and sever the loops of yarns contained on the throats of each of the cut pile hooks to form the cut pile tufts 16. At the same time, the loops of yarn held on the bills of the loop pile loopers are simply pulled off the loopers as the backing material is moved along its path of travel 12, leaving the loop pile tufts 14 of yarn in the backing material 11, as shown in FIG. 1. Thus, the backing fabric will have cut pile and loop pile tufts of yarns in a single pass through the tufting machine formed therein.

In a further alternative embodiment of the invention, as indicated in FIG. 4A, a series of cut/loop loopers or hooks 101 can be substituted for the cut pile hooks positioned along the downstream side of the tufting machine opposite the loop pile loopers 31 for forming the cut pile tufts. As shown in FIG. 4A, the loop pile loopers 31 are spaced from each other so as to define gaps 33 therebetween, while the cut/loop loopers or hooks 101 are spaced transversely so as define gaps 102 therebetween. The loop pile loopers 31 are aligned with the gaps 102 between each of the cut/looper or hooks, while the cut/loop loopers or hooks are each aligned with a gap 33 formed between each of the loop pile loopers 31. In addition, the cut pile needles 17 positioned along the upstream side of the tufting zone will pass through the gap 33 between the loop pile loopers 31 for engagement therewith by the cut/loop loopers or hooks, while the loop pile needles 18, positioned along the downstream side of the tufting zone, will pass through the gaps 102 between each of the cut/loop loopers or hooks for engagement by the bill portions 44 of the loop pile loopers 31 as the loop pile loopers are rocked forwardly during a stroke or cycle of the tufting machine.

Each cut/loop looper or hook 101 (FIG. 4A) generally includes a body 103 with a rear or shank portion 104 mounted within a holder that carries the cut/loop looper or hook about a reciprocating motion into and out of engagement with a cut pile needle 17, and further includes a bill or forward portion 108 that terminates in a pointed or tapered front end or forward end 109. A clip 111 generally is attached to the shank portion 104 of each cut/loop looper or hook 101. Each clip 111 typically is formed from a metal material such as spring steel or other similar, resilient material that can be attached to its looper body 103 by a fastener such as a rivet, bolt, welding or other similar fastening mechanisms as will be understood in the art. The clip includes a forwardly extending front body section 113 having an engaging portion 114 that bears against the forward end 109 of its attached cut/loop looper or hook 101, and terminates in a front or proximal end 116. The forward end 116 is angled slightly outwardly, as is shown in FIG. 4A, such that as the forward end 109 of each cut/loop looper or hook strikes its respective cut pile needle 17, the clip can be urged away from the bill portion of the cut/loop looper or hook to allow the passage of the needle therebetween as the yarn is picked up or taken off its needle 17 to form a loop of yarn along the bill 108 of the cut/loop looper or hook. As the cut pile needles 17 are retracted from engagement with their cut/loop loopers or hooks, the clips will be returned to their tight bearing engagement with the forward end or bill portions of their respective cut/loop loopers or hooks so as to retain the loops of yarn formed therealong for cutting by their associated knives 62.

Another alternative embodiment of the invention for forming synthetic or artificial grass/turf products without necessarily requiring multiple passes of the product through a tufting machine is schematically illustrated in FIG. 4B. In this embodiment, the hooks 50 of the cut pile hook assemblies 32 are located along the downstream side of the tufting zone, aligned with a first or downstream series or group of needles 18 at an elevation corresponding to a first penetration depth to which the downstream needles 18 extend or penetrate through the backing material 11. The loopers 31 of looper assemblies 30 are generally located on the upstream side of the tufting zone T, below and aligned with the needles 17 of a second or upstream row of needles. As FIG. 4B indicates, the loopers 31 are arranged at an elevation substantially corresponding to a second penetration depth to which the upstream needles 17 extend or penetrate through the backing material. During a tufting operation, the hooks 50 and loopers 31 will engage the needles 18 and 17 on the downstream and upstream sides of the tufting zone, respectively, without passing between or intermeshing with each other, as illustrated in FIG. 4B. The loopers and hooks will pick and pull loops of yarns from their needles, with the loops formed by the hooks being cut by knives 62 to form cut pile tufts 16 interspersed with the loop pile tufts 14 and having a greater length or pile height.

Figure 5A:
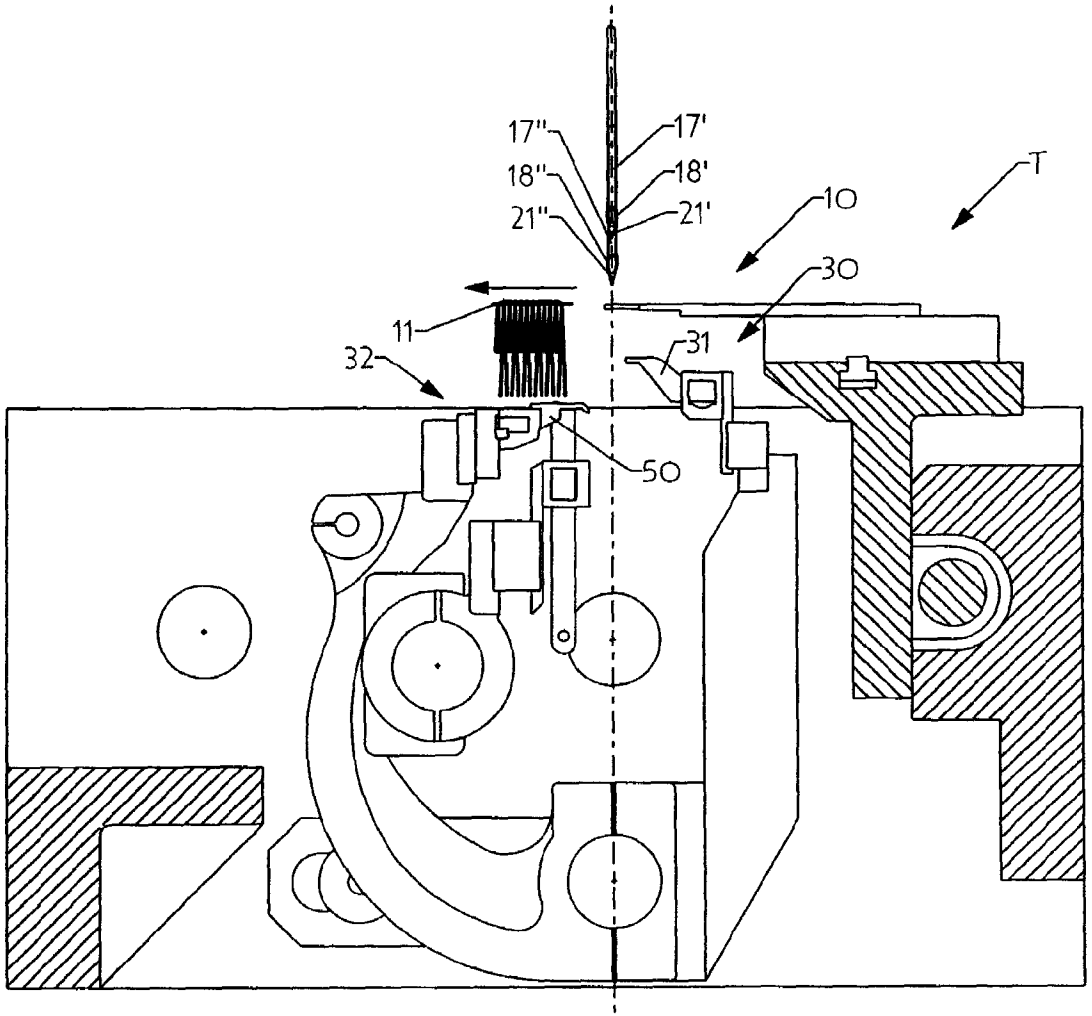
FIG. 5A is a side elevational view of a tufting machine incorporating another alternative embodiment of the present invention with cut pile hooks and loop pile loopers being arranged in opposed, vertically spaced rows in alignment with the needles of an inline needle bar.
Figure 5B:
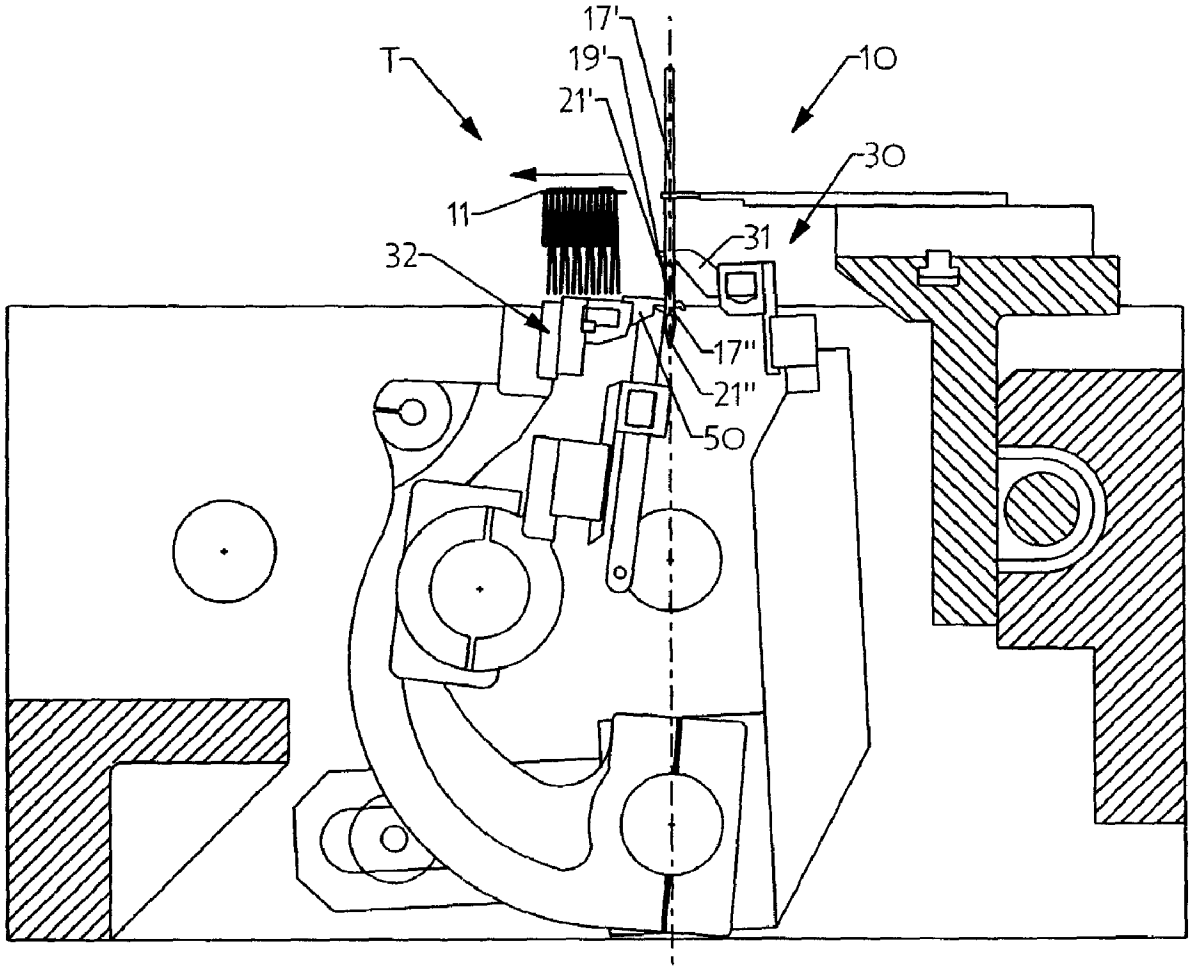
FIG. 5B is a side elevational view illustrating the engagement of the cut pile hooks and loop pile loopers through their associated needles in the tufting machine of FIG. 5A.
Figure 6:
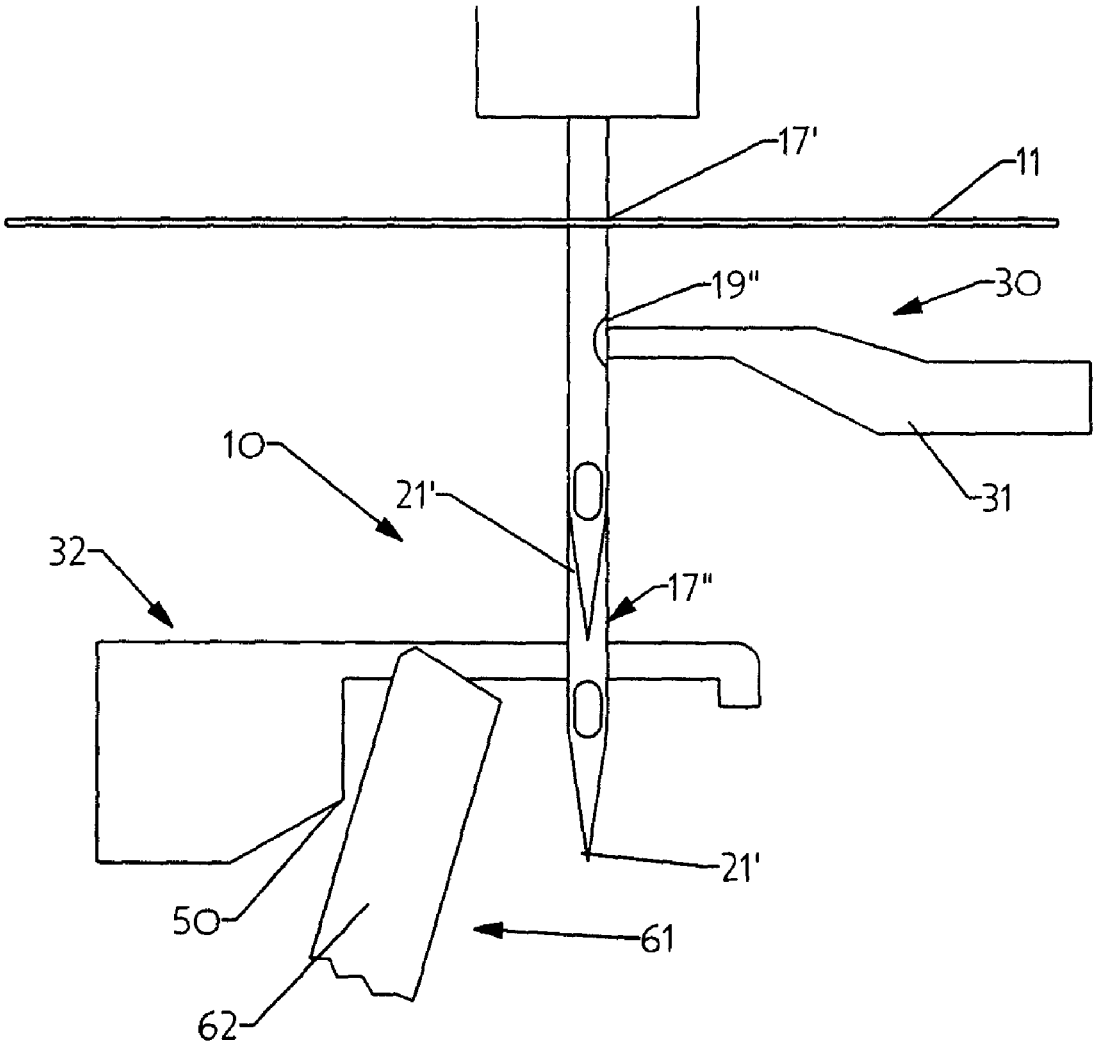
FIG. 6 is a schematic illustration of the engagement of the inline needles by their respective loop pile loopers and cut pile hooks.
Figure 7:
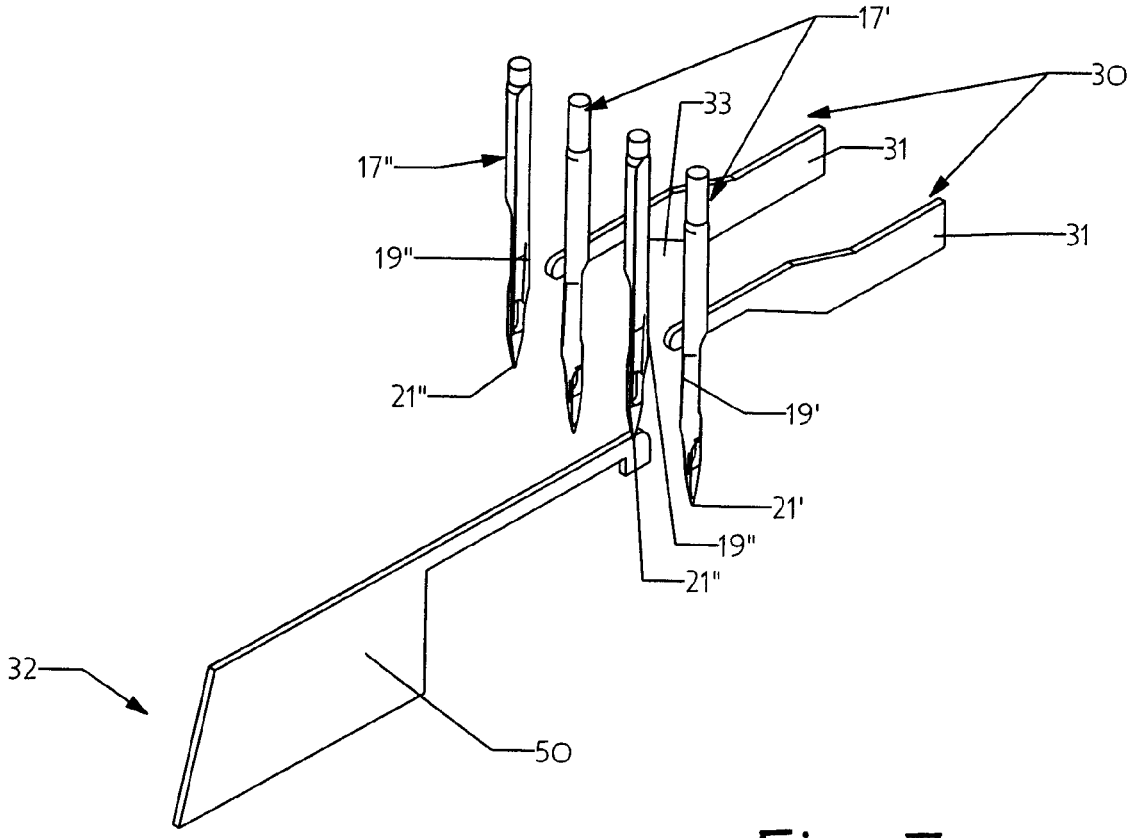
FIG. 7 is a schematic illustration showing the engagement of the inline needles of the tufting machines of FIGS. 5A and 5B with their respective loop pile loopers and cut pile hooks.

In still another alternative embodiment of the invention, shown in FIGS. 5A-7, the tufting machine T can include a single inline needle bar, as noted above, having first and second groups of needles 17' and 17", whose points 21' and 21" extend or project to different elevations or penetration depths. The needles 17' and 17" can be mounted in a single, inline row extending along the length of the needle bar, as indicated in FIGS. 5A-6, or can be staggered along the needle bar, and generally will be engaged from opposite sides by cut pile hooks 50 and loop pile loopers 31 as indicated in FIGS. 6 and 7. The needle bar also can be shiftable by a shift mechanism (not shown), or can be controlled so as to be oscillated or moved in a positive stitch placement type fashion, while running substantially straight rows or tufts, to avoid corn-row type effects in the finished tufted tuft fabrics. As further indicated in FIGS. 5A-7, the first and second groups or series of inline needles 17' and 17" can be mounted in varying lengths such that one set of needles (i.e., 17") will be longer and thus extend down lower than the other set of needles 17', as shown in FIG. 7. Alternatively, the needles 17' and 17" can be substantially the same construction and length, but can be mounted at different elevations along the needle bar so that the lower ends or points 21' and 21" of each of the needles 17'/17" are different elevations, or can include level elevation needles, hooks and loopers.

As illustrated in FIGS. 6 and 7, the take-off areas or portions 19' and 19" of each needle 17' and 17" additionally can be turned opposite for the respective needles 17' and 17". For example, as illustrated in FIG. 7, for each pair of needles 17' and 17", the take-off portions 19'/19" will be oriented so as to face in opposite directions, which can enable closer spacings or gauges for the cut and loop pile tufts of yarns being formed. The hooks and loopers further can be arranged so as to engage alternate ones of the needles, for example, the loopers can engage every even needle 17' and the hooks every odd needle 17." Alternatively, the loopers and hooks can be arranged so as to engage selected needles 17' and/or 17", such as having the loopers engage every third, fourth, etc., needle while the hooks engage the remaining needles, or the hooks can be arranged to engage every third, fourth, etc., needle, for forming more or fewer cut/loop pile tufts as needed to achieve a desired density and/or other pattern effects in the resultant artificial turf/grass product. Other alternative arrangements also can be utilized as needed or desired.

In operation, as indicated in FIGS. 5B-7, the loopers 31 and hooks 50 will move toward each other, into an intermeshing arrangement to engage the first and second groups or series of needles 17' and 17" of the in-line row of needles. The hooks and loopers can be arranged at different elevations as shown in FIGS. 6 and 7 for forming the cut end loop pile tufts having different lengths or pile heights. It further will be understood that there additionally can be other alternative arrangements of loop pile loopers and cut pile hooks that can be utilized with the inline needle bar(s), including the use of level cut loopers or hooks, or the use of loop pile loopers or cut pile hooks on both sides of the tufting zone to form level cut loop pile tufts, all loop pile tufts or all cut pile tufts.

The artificial/synthetic sports grass or turf fabric formed according to the present invention additionally can be formed with two levels of cut pile or loop pile tufts, while generally being run in a single pass through the tufting machine, rather than requiring multiple tufting passes and overtufting of the tufted fabric. In such a system or arrangement, two rows of cut pile hooks or two rows of loop pile loopers can be provided, with a first or upstream row of cut pile hooks generally being vertically spaced from the downstream or second row of cut pile hooks/loop pile loopers. Additionally, two different length needles typically can be used, although it is also possible to use needles of substantially the same length mounted on separate needle bars, with the needles being staggered in terms of their elevation or depth to enable different penetration levels. Still further, the needles can be mounted on a single needle bar in a staggered needle configuration or spacing, or with the needles arranged in-line along the needle bar, and the stroke of the needle bar can be based upon the stroke or penetration depth required for the longest needle to penetrate and be engaged by its corresponding cut pile hooks. Additionally, the cut pile hooks can be spaced in pairs to enable sufficient spacing between each of the pairs for penetration of the needles therebetween the slotting of the needle plates without undue weakening of the needle plates in order to ensure accurate engagement and pickup of the loops of yarn on the needles as the hooks or loopers pass therebetween, especially as the gauges for the tufting machine are narrowed.

Still further, it also will be understood that in addition to various pattern mechanisms or systems such as mechanisms or devices to control the feeding of the yarns to the needles and shifting of the needle bar(s) to prevent excess yarn from being pulled and left on top of the backing material, systems/attachments for forming various pattern effects, such as sculptured or textured pile effects, or the formation of logos or other designs using various different colors and shades of yarn, including backing feed shifters and other pattern systems, also can be used. For example, the present system can utilize a backing control system such as Card-Monroe Corp.'s Virtual Weave™ to control the shifting of the backing material. Such a backing feed control further can be used in conjunction with shifting needle bars, as well as a pattern yarn feed mechanisms to provide further enhanced patterning and formation of desired visual effects. Still further, positive stitch placement also can be utilized, whereby the needle bar(s) are incrementally shifted laterally back and forth across the backing material as they are reciprocated to form tufts in the backing material, in addition to being shifted in steps for pattern formation, in order to tighten and substantially eliminate rowing effects for the tufts so as to create a stronger, more natural looking and denser tufted feel. This can help reduce the amount of fill needed for supporting the tufts, as well as providing better control of the yarn feed to allow for lower weights to the yarns to be used and reduced pile heights of the tufts in order to get the desired density required for enhanced player comfort, support, and ball bounce.

Accordingly, utilizing the principles of the present invention, artificial/synthetic sports grass or turf fabrics or products can be formed utilizing a single pass tufting operation or production, without requiring over-tufting, whereby the backing material is run in a first pass through the first tufting machine (i.e., loop pile machine) and then the initially tufted material taken to and run through a second tufting machine in a second pass or operation. In addition, loop pile tufts can be formed with sufficient density, height, and spacing, to provide enhanced support for the cut pile tufts that generally are of higher pile heights, with the loop pile tufts being formed by operation of the loopers reaching through the front row of needles to the rear row of needles for making tufts that will substantially eliminate sew through of the loop pile tufts by the cut pile needles. Still further, the cut pile tufts can be formed by the hooks reaching through the rear row of needles to the front rows of needles to form the cut pile tufts in the fabric, without further requiring over-sewing of the loop pile tufts.

As a result, the finished tufted turf fabric can be formed with enhanced rigidity, with the loop pile tufts supporting the cut pile tufts so as to make such tufts in the resultant turf fabric stronger and more resistant to bending over due to loads such as crushing forces during play. Still further, the use of various pattern devices as discussed above can enable variable pile heights for the cut and loop pile tufts so as to vary the characteristics of the tufted turf fabric to meet various desired standards for cushioning, support, ball roll, and ball bounce, all while helping to reduce the amount of fill with particulate matter required for support of the tufts, and further enable various designs or pattern effect to also be formed in the resultant tufted turf fabrics.

The present invention further enables the passing of the loopers and hooks through the gaps defined therebetween with the incidents of previously sewn loops of yarn being engaged by the cut pile hooks during the production of finer or smaller gauge (i.e., 5/32-1/16 gauge) carpets being minimized, while still further enabling the stagger between the rows of needles to be reduced to as short as approximately ½ inch-approximately ¼ inch or less without the knives engaging the previously sewn loops or otherwise engaging and interfering with the operation of the loopers. As a result, given the reduction in the stagger, the problems of side matching, i.e., matching of the left and right seam of a carpet, are minimized since the stagger can be reduced, which correspondingly reduces the stretching and/or necking of the backing material as the backing material passes passing through the tufting zone.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A tufting machine for forming an artificial/synthetic sports turf, comprising:

a first row of needles positioned adjacent an upstream side of a tufting zone of the tufting machine and moveable to a first penetration depth, each needle having a pickup area formed therealong and carrying a synthetic grass yarn for introduction into a backing moving through the tufting zone;

a second row of needles spaced transversely across the tufting zone from said first row of needles and moveable to a second penetration depth that is different from said first penetration depth, said second row of needles each having a pickup area and carrying synthetic grass yarns for introduction into a base fabric;

a series of loopers moveable between said needles of said first row of needles and arranged at an elevation substantially corresponding to said second penetration depth so as to engage said needles of said second row of needles so as to engage and pickup the yarns therefrom to form the loop pile tufts in the backing;

a series of hooks positioned opposite said loopers and at a different elevation from said loopers substantially corresponding to said first penetration depth, said hooks moveable between said needles of said second row of needles into engagement with said needles of said first row of needles to pickup the yarns therefrom; and a series of knives each positioned along a pickup side of one of said hooks and adapted to engage the yarns picked up by the hooks for forming the cut pile tufts in the backing.

2. The tufting machine of claim 1 and wherein said knives are of an opposite hand cutting to the pickup of said hooks.

3. the tufting machine of claim 2 and wherein said knives are right hand cut and said hooks are left hand pickup.

4. The tufting machine of claim 2 and wherein said knives are left hand cut and said hooks are right hand pickup.

5. The tufting machine of claim 2 and wherein said knives are generally aligned with said needles of said first row of needles.

6. A method of forming an artificial/synthetic turf, comprising:

moving a backing along a path of travel through a tufting zone;

engaging the backing with a first row of spaced needles carrying a plurality of yarns through the backing to a first penetration depth;

engaging the backing with a second row of spaced needles, transversely spaced from the first row of needles across the tufting zone and carrying a second plurality of yarns through the backing to a second penetration depth that differs from the first penetration depth of the first plurality of yarns;

moving a plurality of hooks across the tufting zone between the needles of the second row of needles and into engagement with the yarns carried by the needles of the first row of needles through the backing to a first penetration depth;

reciprocating a series of knives into contact with the yarns engaged by the hooks to form cut pile tufts in the backing; and moving a series of loopers arranged at a second elevation that is vertically spaced from the hooks across the tufting zone between the needles of the first row of needles and into engagement with the yarns carried by the needles of the second row of needles through the backing to the second penetration depth to form the loop pile tufts in the backing;

wherein the loop pile tufts and cut pile tufts are formed at different pile heights.

7. The method of claim 6 and wherein providing the knives along the pickup side of each hook comprises aligning each knife with one of the needles of the needle of the first row of needles.

8. The method of claim 6 and further comprising cutting a series of yarns engaged on the hooks with the knives to form the cut pile tufts.

9. The method of claim 6 and further comprising shifting the needles laterally with respect to the backing.

10. The method of claim 6 and wherein the first penetration depth extends to a lower elevation than the second penetration depth.

11. A system for forming artificial/synthetic grass turf products, comprising:

a plurality of needles reciprocably moveable into and out of a backing material, including a first series of needles carrying synthetic grass yarns through the backing material to a first penetration depth, and a second series of needles carrying synthetic grass yarns through the backing material to a second penetration depth that differs from said first penetration depth by a defined vertical spacing;

a plurality of loopers mounted beneath said first series of needles and adapted to engage said second series of needles for forming loop pile tufts in the backing material; and a plurality of cut pile hook assemblies mounted in an opposite facing arrangement from said loopers, comprising a series of cut pile hooks adapted to engage said first series of needles and pick loops of yarns therefrom, and a series of knives each aligned with one of said hooks for engaging and cutting the loops picked by cut pile hooks to form cut pile tufts in the backing material;

wherein said cut pile hooks are located at an elevation corresponding to said first penetration depth of said first series of needles, and said loopers are vertically spaced from said cut pile hooks and are located at an elevation corresponding to said second penetration depth of said second series of needles and engage said second row of needles to form the loop pile tufts at a different height than the cut pile tufts.

12. The system of claim 11 and wherein said first penetration depth extends to an elevation lower than said second penetration depth.

13. The system of claim 11 and wherein said first and second series of needles of said plurality of needles are arranged in-line along a single needle bar.

14. The system of claim 11 and wherein said first and second series of needles of said plurality of needles are arranged in transversely spaced rows.

15. The system of claim 11 and wherein said knives are of an opposite hand cutting to a pickup portion of said cut pile hooks.

16. The system of claim 14 and wherein said knives are right hand cut and said hooks are left hand pickup.

17. The system of claim 14 and wherein said knives are left hand cut and said hooks are right hand pickup.

18. A tufting machine for forming artificial/synthetic grass turf products, comprising:

a first group of needles reciprocably moveable into and out of a backing material, wherein said first series of needles carry a series of synthetic grass yarns through the backing material to a first penetration depth;

a second group of needles transversely spaced from said first series of needles and reciprocably moveable into and out of the backing material, wherein said second series of needles carry an additional series of synthetic grass yarns through the backing material to a second penetration depth that extends to a depth that differs from said first penetration depth;

a series of loopers mounted beneath the backing material and adapted to engage selected needles of said second group of needles for forming loop pile tufts in the backing material; and a series of cut pile hook assembles mounted beneath the backing material in an opposite facing arrangement from and spaced from said loopers, said cut pile hook assemblies each comprising a series of cut pile hooks adapted to engage selected needles of said first series of needles and pick loops of yarns therefrom, and a series of knives each aligned with one of said hooks for engaging and cutting the loops picked by cut pile hooks to form cut pile tufts in the backing material;

wherein said cut pile hooks are located at an elevation corresponding to said first penetration depth of said first group of needles, and said loopers are located at a different elevation, vertically spaced from said cut pile hooks and corresponding to said second penetration depth of said second group of needles so as to form cut pile tufts and loop pile tufts of synthetic grass yarns at different pile heights sufficient to provide a desired density to enable the artificial/synthetic grass turf products to be formed in a single pass therethrough.

19. The tufting machine of claim 18 and wherein said knives are of an opposite hand cutting to a pickup portion of said cut pile hooks.

20. The tufting machine of claim 18 and further comprising a pair of needle bars.

21. The tufting machine of claim 20 and wherein said first group of needles are mounted to a downstream one of said needle bars and said second group of needles are mounted to an upstream one of said needle bars.

22. The tufting machine of claim 18 and wherein said first and second groups of needles are mounted in-line along a single needle bar.

* * * * *